US010871058B2

(12) United States Patent
Morrison, III

(10) Patent No.: US 10,871,058 B2
(45) Date of Patent: Dec. 22, 2020

(54) PROCESSES AND SYSTEMS FOR INJECTING A FLUID INTO A WELLBORE

(71) Applicant: Guy Morrison, III, Gillette, WY (US)

(72) Inventor: Guy Morrison, III, Gillette, WY (US)

( * ) Notice: Subject to any disclaimer, the term of this patent is extended or adjusted under 35 U.S.C. 154(b) by 0 days.

(21) Appl. No.: 16/393,512

(22) Filed: Apr. 24, 2019

(65) Prior Publication Data

US 2019/0323326 A1 Oct. 24, 2019

Related U.S. Application Data

(60) Provisional application No. 62/661,921, filed on Apr. 24, 2018.

(51) Int. Cl.

| | |
|---|---|
| ***E21B 21/06*** | (2006.01) |
| ***E21B 43/20*** | (2006.01) |
| ***E21B 43/16*** | (2006.01) |
| ***E21B 43/12*** | (2006.01) |

(52) U.S. Cl.

CPC ..... *E21B 43/162* (2013.01); *E21B 21/062* (2013.01); *E21B 43/128* (2013.01); *E21B 43/20* (2013.01)

(58) Field of Classification Search

CPC .. E21B 21/062; E21B 41/0057; E21B 43/128; E21B 43/20

See application file for complete search history.

(56) References Cited

U.S. PATENT DOCUMENTS

| | | | | |
|---|---|---|---|---|
| 3,975,115 | A | 8/1976 | Fisher et al. | |
| 4,143,309 | A | 3/1979 | Patterson | |
| 4,186,419 | A | 1/1980 | Sims | |
| 4,392,782 | A * | 7/1983 | Kuehn, III | E21B 43/128 307/118 |

(Continued)

FOREIGN PATENT DOCUMENTS

| | | |
|---|---|---|
| CN | 102061722 | 5/2011 |
| WO | 2010139019 | 12/2010 |

OTHER PUBLICATIONS

"Drinking Water Tech Tips: Hydropneumatic Tank Control Systems"; Washington State Department of Health; Division of Environmental Health—Office of Drinking Water; DOH 331-380; May 2011, Revised.

(Continued)

*Primary Examiner* — Cathleen R Hutchins

(74) *Attorney, Agent, or Firm* — Edmonds & Cmaidalka, P.C.

(57) ABSTRACT

Processes and systems for injecting a fluid into a wellbore. In some examples, the process can include introducing a water-rich product separated from a hydrocarbon production fluid that can include one or more hydrocarbons and water into a fluid storage apparatus. The water-rich product from the fluid storage apparatus can be introduced into a subterranean housing that can include a pressurizing apparatus at least partially disposed therein. The subterranean housing can be at least partially disposed under a surface of the earth. The pressurizing apparatus can have an inlet located within the subterranean housing and below the surface of the earth. The water-rich product from the subterranean housing can be introduced into the inlet of the pressurizing apparatus. A pressurized water-rich product from an outlet of the pressurizing apparatus can be introduced into an injection well.

20 Claims, 3 Drawing Sheets

(56) References Cited

U.S. PATENT DOCUMENTS

| | | | | |
|---|---|---|---|---|
| 4,396,353 | A | 8/1983 | MacDonald | |
| 4,934,458 | A | 6/1990 | Warburton et al. | |
| 5,049,046 | A | 9/1991 | Escue et al. | |
| 5,253,982 | A | 10/1993 | Niemiec et al. | |
| 5,466,127 | A | 11/1995 | Arnswald | |
| 5,563,490 | A | 10/1996 | Kawaguchi | |
| 5,634,522 | A | 6/1997 | Hershberger | |
| 5,883,489 | A | 3/1999 | Konrad | |
| 6,048,175 | A | 4/2000 | Corlew et al. | |
| 6,077,044 | A | 6/2000 | Reid | |
| 6,167,965 | B1 * | 1/2001 | Bearden | E21B 43/121 166/250.15 |
| 6,254,353 | B1 | 7/2001 | Polo et al. | |
| 6,264,431 | B1 | 7/2001 | Triezenberg | |
| 6,481,973 | B1 | 11/2002 | Struthers | |
| 7,069,985 | B2 * | 7/2006 | Wang | E21B 43/128 166/105 |
| 7,168,924 | B2 | 1/2007 | Beck et al. | |
| 7,999,502 | B2 | 8/2011 | Philippe et al. | |
| 8,082,217 | B2 | 12/2011 | Crossley et al. | |
| 8,235,111 | B2 | 8/2012 | Fink | |
| 8,314,583 | B2 | 11/2012 | Yohanan et al. | |
| 8,776,617 | B2 | 7/2014 | Durham et al. | |
| 9,057,256 | B2 | 6/2015 | Ige et al. | |
| 9,121,270 | B2 | 9/2015 | Seitter | |
| 9,441,633 | B2 | 9/2016 | Sheth et al. | |
| 2013/0199775 | A1 | 8/2013 | Burleigh | |
| 2013/0278183 | A1 | 10/2013 | Liang et al. | |
| 2017/0146015 | A1 | 5/2017 | Hawes et al. | |

OTHER PUBLICATIONS

"Varialble Speed Pump Controller"; Xylem Inc.; (http://unitedstates.xylemappliedwater.com/2011/05/14/variable-speed-pump-controller/) accessed Feb. 12, 2018; Copyright 2018.

"Water Automation Systems"; eWAS Water Automation System; (http://www.ewaterautosys.com/water-automation-systems.html) accessed Feb. 12, 2018.

* cited by examiner

PROCESSES AND SYSTEMS FOR INJECTING A FLUID INTO A WELLBORE

CROSS-REFERENCE TO RELATED APPLICATION

This application claims priority to U.S. Provisional Patent Application No. 62/661,921, filed on Apr. 24, 2018, which is incorporated by reference herein.

BACKGROUND

Field

Embodiments described generally relate to processes and systems for injecting a fluid into one or more wellbores. More particularly, such embodiments relate to processes and systems for injecting water into one or more injection wells.

Description of the Related Art

Hydrocarbons, e.g., natural gas and petroleum, is recovered from hydrocarbon-bearing subterranean formations via production wells (i.e., wellbores) drilled into the subterranean formation. When the recovery rate of crude oil from a formation is inadequate or the formation has become depleted, supplemental operations (often referred to as secondary or post-primary recovery operations) can be employed. In some of these supplemental operations, a fluid, e.g., water or primarily water, is injected into the formation by pumping it through one or more injection wells. In some examples, the fluid injected into the formation can be used to pressurize the formation and push or otherwise displace hydrocarbons therefrom that can then be recovered from a production well. In other supplemental operations, the fluid, e.g., water, can be disposed of by injecting the fluid into a disposal well.

To inject such fluids into a wellbore, conventional injection wells utilize charge pump(s) to supply the fluid to a horizontal pump that pressurizes the fluid to inject into the wellbore. These charge pumps and horizontal pumps are prone to leaking, typically require several shutdowns a year for preventive maintenance, are typically replaced every one to two years, and require a large amount of electricity to operate.

There is a need, therefore, for improved processes and systems for injecting a fluid into a wellbore.

SUMMARY

Processes and systems for injecting a fluid, e.g., water, into a wellbore or a unit of wellbores are provided. In some examples, the process can introduce a water-rich product separated from a hydrocarbon production fluid comprising a hydrocarbon and water into a fluid storage apparatus. The water-rich product from the fluid storage apparatus can be introduced into a subterranean housing comprising a pressurizing apparatus at least partially disposed therein. The subterranean housing can be at least partially disposed under a surface of the earth. The pressurizing apparatus can have an inlet located within the subterranean housing and below the surface of the earth. The water-rich product from the subterranean housing can be introduced into the inlet of the pressurizing apparatus. A pressurized water-rich product from an outlet of the pressurizing apparatus can be introduced into an injection well.

In some examples a system can include a fluid storage apparatus that can be configured to store a water-rich product separated from a hydrocarbon production fluid. The system can also include a subterranean housing comprising a pressurizing apparatus at least partially disposed therein. The subterranean housing can be at least partially disposed under a surface of the earth. The pressurizing apparatus can include an inlet located within the subterranean housing and below the surface of the earth. The pressurizing apparatus can also include an outlet configured to eject a pressurized water-rich product therefrom. The system can also include an injection well configured to introduce the pressurized water-rich product into a subterranean formation.

In some examples, a process can include injecting a fluid into an injection well. The process can include recovering a fluid from a fluid storage apparatus located on a surface of the earth. The fluid can be introduced into a subterranean housing that can include a pressurizing apparatus at least partially disposed therein. The subterranean housing can be at least partially disposed under a surface of the earth. The pressurizing apparatus can have an inlet located within the subterranean housing and below the surface of the earth. The fluid from the subterranean housing can be introduced into the inlet of the pressurizing apparatus. A pressurized fluid from an outlet of the pressurizing apparatus can be introduced into an injection well.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
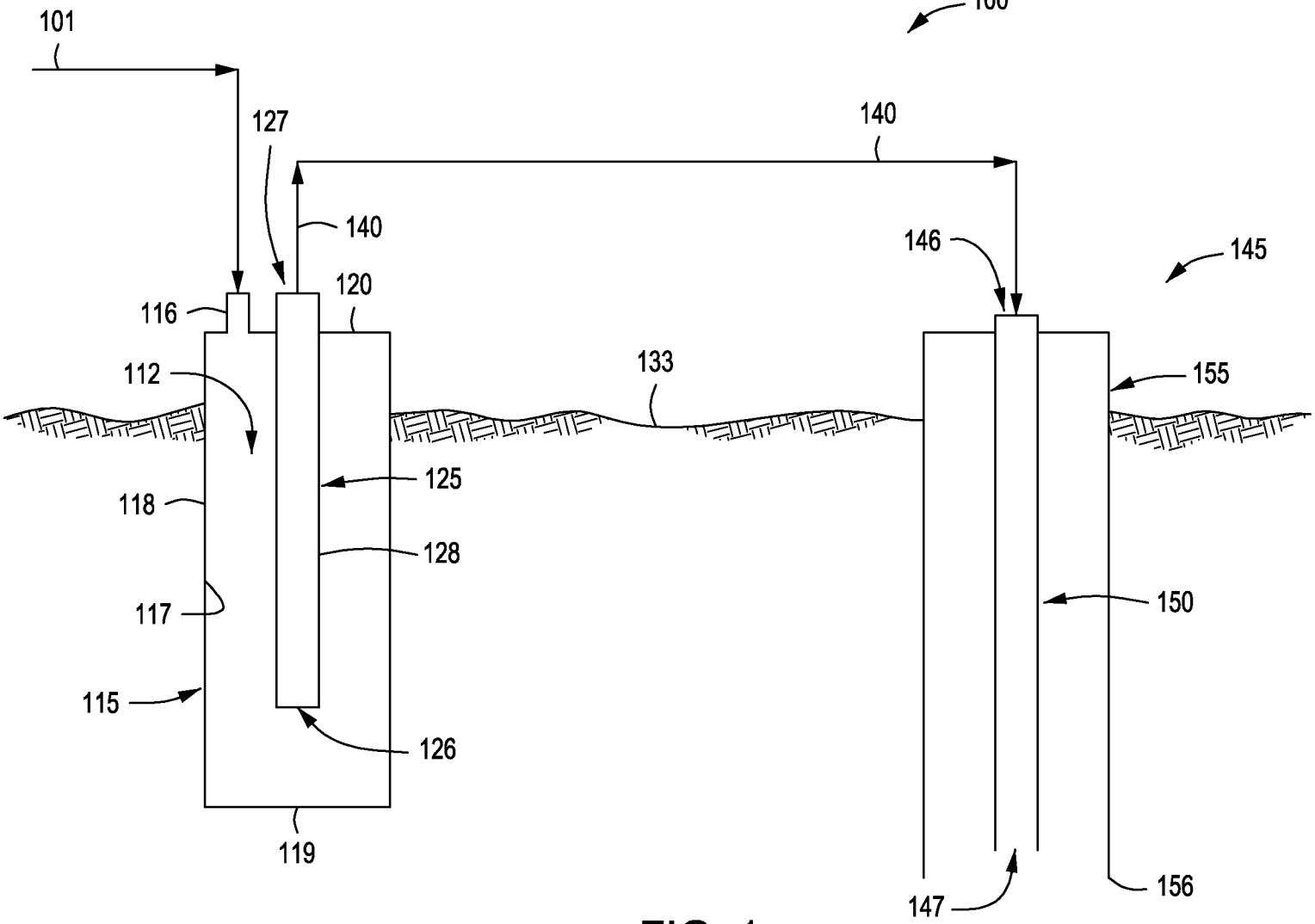
FIG. 1 depicts an illustrative system for injecting a fluid into a well that includes a pressurizing apparatus at least partially disposed within a subterranean housing, the pressurizing apparatus having an inlet disposed within the subterranean housing and below a surface of the earth, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the system and processes for using same may be equally effective at various angles or orientations.

A more detailed description of the preferred embodiments follows. In some examples, the process for injecting a fluid into a well can include introducing the fluid into a container or "subterranean housing" that can include a pressurizing apparatus at least partially disposed therein. The subterranean housing can be at least partially disposed under a surface of the earth and the pressurizing apparatus can have an inlet located within the subterranean housing and below the surface of the earth. The fluid can be introduced from the subterranean housing into the inlet of the pressurizing apparatus. A pressurized fluid can be recovered from an outlet of the pressurizing apparatus and can be introduced into the injection well.

As used herein, the terms "subterranean housing" and "container" refer to any housing, storage, carton, box, bucket, or other suitable object for holding or storing a fluid. The subterranean housing can be completely enclosed, partially enclosed, or open. In some examples, the subterranean housing can be made or composed of metal, polymer, fiberglass, carbon fiber, or combinations or mixtures thereof.

The subterranean housing can be at least partially disposed below the surface of the earth and configured or adapted to hold the pressurizing apparatus at least partially therein. The subterranean housing can have any shape and size. For example, the subterranean housing can have an elliptical cross-sectional shape, an oval cross-sectional shape, a polygonal cross-sectional shape, or any combination thereof. In some examples, the subterranean housing can have an elliptical cross-sectional shape, e.g., a generally circular cross-section, such as a pipe, a tube, a casing, or other elongated structure having an internal volume sized such that the pressurizing apparatus can be at least partially contained, located, or otherwise disposed therein. In other examples, the subterranean housing can have a generally rectangular shape, such as a box or other elongated structure having an internal volume sized such that the pressurizing apparatus can be at least partially contained, located, or otherwise disposed therein.

In some examples, the subterranean housing can include at least a first or "bottom" end that can be located below the surface of the earth and a second or "top" end that can be located above the surface of the earth, at the surface of the earth, or below the surface of the earth. The bottom end of the subterranean housing can be sealed or otherwise closed such that the fluid can be contained within an internal volume of the subterranean housing. For example, when the pressurizing apparatus is at least partially disposed within the subterranean housing, fluid can flow around the pressurizing apparatus and into the inlet of the pressurizing apparatus. As such, the subterranean housing can be configured or adapted to prevent or reduce the likelihood of any fluid introduced thereto from flowing into a subterranean formation adjacent an exterior of the subterranean housing.

In some examples, when the subterranean housing has an elliptical cross-sectional shape, e.g., a substantially circular cross-section, the subterranean housing can have an average cross-sectional length of about 12.7 cm, about 15.2 cm, about 17.8 cm, about 20.3 cm, about 22.9 cm, or about 25.4 cm to about 27.9 cm, about 30.5 cm, about 33 cm, about 35.6 cm, or about 38.1 cm. For example, a subterranean housing having a generally circular cross-section can have an inner diameter of about 12.7 cm to about 38.1 cm, about 25.4 cm to about 30.5 cm, about 17.8 cm to about 27.9 cm, about 22.9 cm to about 33 cm, or about 20.3 cm to about 35.6 cm. In some examples, when the subterranean housing has an elliptical cross-sectional shape, e.g., a substantially circular cross section, the subterranean housing can have a wall thickness (sidewall and/or bottom) of about 0.5 cm, about 0.6 cm, about 0.7 cm, about 0.8 cm, about 0.9 cm, or about 1 cm to about 1.1 cm, about 1.3 cm, about 1.5 cm, about 1.7 cm, about 1.8 cm, about 1.9 cm, about 2 cm, or about 2.1 cm.

In some examples, when the subterranean housing has an elliptical cross-sectional shape, the bottom end, e.g., an elliptical plate, can be sized to accommodate at least some overlap of the sidewall to allow the bottom end to be secured thereto, e.g., via a weld seam, to provide the subterranean housing with a sealed or otherwise closed bottom end. In other examples, when the subterranean housing has an elliptical cross-sectional shape, the bottom end, e.g., an elliptical cap, can be threadedly secured to an end of the subterranean housing to provide the subterranean housing with a sealed or otherwise closed bottom end. In other examples, when the subterranean housing has an elliptical cross-sectional shape, the bottom end can be integrated with an end of the subterranean housing to provide the subterranean housing with a sealed or otherwise closed bottom end. For example, the subterranean housing can be fabricated or otherwise made from fiberglass that can be formed into a single body without seams between two or more sections or pieces. It should be understood that the subterranean housing having other cross-sectional shapes, i.e., non-elliptical cross-sectional shape, can have bottom ends shaped appropriately to provide the subterranean housing with a sealed or otherwise closed bottom end. In other examples, the first end of the subterranean housing can be crimped, squeezed and welded, plugged, or otherwise sealed.

In some examples, the subterranean housing can have a length from the first end to the second end of about 6 m, about 7.5 m, about 9 m, about 10.5 m, about 12 m, about 13.5 m, or about 15 m to about 16.5 m, about 18 m, about 19.5 m, about 21 m, about 23 m, about 24.5 m, about 26 m, about 27 m, about 29 m, about 30.5 m, or greater. In some examples, the subterranean housing can be assembled from a plurality of segments or sections, e.g., a plurality of casing sections, which can be threadedly connected to one another, welded to one another, or otherwise secured to one another to make a subterranean housing having a desired or predetermined length from the first end to the second end.

In some examples, the cross-sectional length, e.g., diameter, of the subterranean housing can be sized according to one or more process variables. Illustrative process variables that can be used to determine the cross-sectional length of the subterranean housing can be or can include, but are not limited to, a desired or predetermined flow rate of the fluid into the inlet of the pressurizing apparatus, a composition or expected composition of the fluid to be introduced into the inlet of the pressurizing apparatus, an outer cross-sectional length, e.g., diameter, of the pressurizing apparatus relative to an inner cross-sectional length of the subterranean housing, or any combination thereof.

As used herein, the term "pressurizing apparatus" refers to any pump or other device, system, or equipment configured or adapted to raise, lift, drive, exhaust, or compress a fluid. The pressurizing apparatus can include an inlet for receiving the fluid and an outlet for expelling or discharging the fluid therefrom. The inlet of the pressurizing apparatus can be located or otherwise disposed below or beneath the outlet of the pressurizing apparatus. In some examples, the inlet of the pressurizing apparatus can be located beneath or axially below the outlet of the pressurizing apparatus. In some examples, a longitudinal axis of the pressurizing apparatus can be substantially vertical with respect to the surface of the earth adjacent the subterranean housing. The fluid introduced into the subterranean housing can flow along a flow path located between an inner surface of the subterranean housing and an outer surface of at least a portion of the pressurizing apparatus and into the inlet of the pressurizing apparatus. Suitable pressurizing apparatus can be or can include, but are not limited to, one or more positive displacement pumps, gear pumps, screw pumps, and/or centrifugal pumps. Such pumps can be vertical and/or submersible. Such pumps also can be single stage or multistage.

The normal well and tear on the pressurizing apparatus during operation thereof can be substantially reduced when the longitudinal axis of the pressurizing apparatus is substantially vertical as compared to a comparative pressurizing apparatus having a longitudinal axis that is substantially horizontal and configured to move the same fluid therethrough at the same rate as the pressurizing apparatus. As such, when the longitudinal axis of the pressurizing apparatus is substantially vertical, the operating life span of the pressurizing apparatus can be significantly increased as compared to the operating life span of the comparative pressurizing apparatus having a longitudinal axis that is substantially horizontal and configured to move the same fluid therethrough at the same rate as the pressurizing apparatus. In some examples, the operating life span of the pressurizing apparatus can be increased to about 3, 3.5, 4, 5, 5.5, 6, 6.5, 7, 7.5, 8, or more years as compared to the comparative pressurizing apparatus having the longitudinal axis substantially horizontal that typically has an operating life span of only about 1 to 2 years.

The electric energy or power consumed during operation of the pressurizing apparatus can be substantially reduced when the longitudinal axis of the pressurizing apparatus is substantially vertical as compared to a comparative pressurizing apparatus having a longitudinal axis that is substantially horizontal and configured to move the same fluid therethrough at the same rate as the pressurizing apparatus. In some examples, the electric energy or power consumed during operation of the pressurizing apparatus can be reduced by about 5%, about 10%, about 15%, about 20%, about 25%, or about 30% to about 35%, about 40%, about 45%, about 50%, about 55%, about 60%, or about 65% or more as compared to a comparative pressurizing apparatus having a longitudinal axis that is substantially horizontal and configured to move the same fluid therethrough at the same rate as the pressurizing apparatus. In other examples, the electric energy or power consumed during operation of the pressurizing apparatus can be reduced by at least 5%, at least 10%, at least 15%, at least 20%, at least 25%, at least 30%, at least 35%, at least 40%, at least 45%, at least 50%, at least 55%, or at least 60% or more, as compared to a comparative pressurizing apparatus having a longitudinal axis that is substantially horizontal and configured to move the same fluid therethrough at the same rate as the pressurizing apparatus.

A suitable pressurizing apparatus can include an inlet, an outlet, a motor, and at least one rotating component, vane or impellor. In some examples, the motor can be disposed toward or at a first end of the pressurizing apparatus, the outlet can be disposed toward or at a second end of the pressurizing apparatus, the rotating component can be disposed adjacent the outlet, and the inlet can be disposed between the rotating component and the motor. The first end of the pressurizing apparatus can be located or otherwise disposed closer to a bottom of the subterranean housing than the second end of the pressurizing apparatus. As such, the inlet of the pressurizing apparatus can be located below the outlet of the pressurizing apparatus. In some examples, the inlet of the pressurizing apparatus can be located beneath or axially below the outlet of the pressurizing apparatus. The fluid introduced into the subterranean housing can flow along a flow path located between an inner surface of the subterranean housing and an outer surface of at least a portion of the pressurizing apparatus and into the inlet of the pressurizing apparatus. The pressurizing apparatus can include any number of stages or bowls such that, during operation, the pressurized fluid can be recovered from the pressurizing apparatus at a predetermined or otherwise desired flow rate and at a predetermined or otherwise desired pressure.

In some examples, the pressurizing apparatus can also include a seal. In such example, the motor of the pressurizing apparatus can be disposed toward or at the first end of the pressurizing apparatus, the outlet can be disposed toward or at the second end of the pressurizing apparatus, the seal can be disposed adjacent the motor, the rotating component can be disposed adjacent the outlet, and the inlet can be disposed between the seal and rotating component. The seal can prevent or reduce the likelihood of any of the fluid from flowing into the motor during operation of the pressurizing apparatus. In some examples, the motor, seal (if present), inlet, the rotating component, and outlet can be substantially axially aligned with respect to one another. In some examples, a longitudinal axis of the pressurizing apparatus can be substantially vertical. In some examples, a longitudinal axis of the pressurizing apparatus can be substantially vertical with respect to the surface of the earth adjacent the subterranean housing.

In some examples, the pressurizing apparatus can also include a shroud. The shroud (if present) can be disposed about the inlet, the seal (if present), and at least a portion of the motor such that a flow path from the first end of the pressurizing apparatus is formed between the shroud and an outer surface of at least a portion of the motor, the outer surface of the seal (if present), and the inlet. As such, the shroud can be configured or adapted to direct the fluid downward into the subterranean housing between the inner surface of the subterranean housing and an outer surface of the shroud toward the first end of the pressurizing apparatus and the fluid can flow through the flow path between the shroud and at least a portion of the motor and the seal (if present) and into the inlet of the pressurizing apparatus. Flowing the fluid between the shroud and at least a portion of the motor and into the inlet can cool the motor during operation, thus preventing or reducing the tendency of the motor to overheat during operation of the vertical submersible pump.

Illustrative commercially available pressurizing apparatus can include, but are not limited to, vertical pumps like the 675 series from Schlumberger that has a rating of 12,000 barrels per day and includes a seal and motor, and the 862 series available from General Electric that is rated at 20,000 barrels per day pump and also includes a seal and motor.

In some examples, one or more operational parameter of the pressurizing apparatus can be monitored during operation of the pressurizing apparatus. In some examples, a vibration of the pressurizing apparatus, a speed at which the rotational component rotates, an amount of electricity being consumed by the motor, and/or any other operational parameter or combinations of operational parameters can be monitored during operation of the pressurizing apparatus. For example, if the vibration, speed at which the rotational component rotates, and/or an amount of electricity consumed by the motor exceeds a pre-determined value the pressurizing apparatus can automatically be shut off. In another example, if the vibration, speed at which the rotational component rotates, and/or an amount of electricity consumed by the motor fall below a pre-determined value the pressurizing apparatus can automatically be shut off.

In some examples, the vibration of the pressurizing apparatus is not monitored. It has been found that when the longitudinal axis of the pressurizing apparatus is substantially vertical, monitoring the vibration of the pressurizing apparatus can be optional and, therefore, not needed. The vibration of a comparative pressurizing apparatus that has a longitudinal axis that is substantially horizontal and configured to move the same fluid therethrough at the same rate as the pressurizing apparatus, however, needs to be monitored because the vibration frequently exceeds a predetermined threshold. When the predetermined threshold is exceed during operation of the comparative pressurizing apparatus, the comparative pressurizing apparatus needs to be shut down and adjusted to avoid damage. The rotating component within the comparative pressuring apparatus tends fall out of alignment due to bearings wearing out, the rotating component becoming bent or otherwise out of shape, etc. at a significantly faster rate than the pressurizing apparatus having the substantially vertical longitudinal axis.

The fluid can be any one or more gases, one or more liquids, or combinations thereof. The fluid, for example, can be a multi-phase gas and liquid mixture. In some examples, the fluid can be or can include water. In other examples, the fluid can include water; one or more salts; algae; fungi; bacteria; dissolved gases, e.g., oxygen, carbon dioxide, and/or hydrogen sulfide; entrained hydrocarbons; entrained solid or particulate matter; or any mixture thereof. In some examples, the fluid can be salt water. In some examples, the fluid can be a filtrate, chemically treated, and/or have undergone other processing to produce a fluid having a desired or predetermined composition. If the fluid includes an undesirable amount of solids, the solids content can be reduced by filtering, centrifugal separation, settling, and/or other processing known in the art.

In some examples, the fluid can be or can include a water-rich product separated from a hydrocarbon production fluid that can also be referred to as "produced water". The particular composition of the water-rich product can widely vary and can depend, at least in part, on the particular hydrocarbon production fluid from which the water-rich product can be separated. In some examples, the water-rich product can be a mixture of water and dissolved and/or particulate organic material and/or dissolved and/or particulate inorganic material that spans from essentially freshwater to concentrated saline brine. By "water-rich product" it is meant, an aqueous mixture of at least 50 vol %, at least 60 vol %, at least 70 vol %, at least 80 vol %, at least 90 vol %, at least 95 vol % of water, and the balance being other solids, hydrocarbons, chemicals, surfactants, etc. The hydrocarbons can be or include, but are not limited to, crude oil or a fraction derived from crude oil. In some examples, the hydrocarbons can be or include, but are not limited to, methane, ethane, propane, butane, pentane, hexane, heptane, naphtha, a gas oil, a waxy residue, a resid, fractions thereof, or any mixture thereof.

Once pressurized using the pressurizing apparatus, the fluid can be injected or otherwise introduced into an inlet of a wellbore. As used herein, the terms "well" and "wellbore" are used interchangeably to mean the same thing, i.e. a hole in the ground. When the wellbore is being used to inject a fluid, such as water, the water-rich product or other fluid, the wellbore is referred to herein as an "injection wellbore" or "injection well".

In some examples, the injection well can include an inner body and an outer body. In some examples, the inner body and/or the outer body can be or can include one or more conduits, pipes, tubes, casings, or other elongated structure(s) having a volume contained therein. The inner body and the outer body can be sized such that the inner body can be at least partially disposed within the outer body. In some examples, a first or bottom end of the outer body can be open and the pressurized fluid can exit the open end or outlet of the inner body and flow into the subterranean formation adjacent the open end of the outer body.

In some examples, the injection well can introduce the pressurized fluid into an underground formation that includes hydrocarbons disposed therein, which can increase or enhance the recovery of the hydrocarbons from the underground formation from another wellbore, i.e., a production well. The injection of the pressurized fluid product into a formation that includes hydrocarbons disposed therein can also be referred to as "a waterflood" or "waterflooding". In another example, the injection well can introduce the pressurized fluid into a disposal well that can contain the pressurized fluid. For example, the disposal well can have an impermeable cap formation and/or an impermeable base formation capable of containing the pressurized fluid therein.

The pressure of the pressurized fluid can widely vary and can depend, at least in part, on the particular subterranean formation the injection well is configured or adapted to introduce the pressurized fluid into. In some examples, the pressure of the pressurized fluid can be sufficient to cause the pressurized fluid to flow into a formation that includes hydrocarbons disposed therein, a disposal well, or other subterranean location.

The pressurized fluid can be introduced into the injection well at a pressure sufficient to cause the pressurized fluid to flow into the subterranean formation. The particular pressure of the fluid introduced into the injection well can be based, at least in part, on the pressure within the formation that includes hydrocarbons disposed therein, the disposal well, or any other subterranean location the injection well introduces the pressurized fluid into. In some examples, the pressurized fluid can be introduced into the injection well at a pressure of about 3 MPa, about 3.5 MPa, about 5 MPa, about 6.5 MPa, about 8 MPa, or about 10 MPa to about 15 MPa, about 20 MPa, about 25 MPa, about 30 MPa, or about 35 MPa.

In some examples, the pressurized fluid can be introduced into the injection well at a rate of about 150 $m^3$/day, about 500 $m^3$/day, about 750 $m^3$/day, about 1,000 $m^3$/day, about 1,500 $m^3$/day, or about 2,000 $m^3$/day to about 2,500 $m^3$/day, about 3,500 $m^3$/day, about 4,500 $m^3$/day, about 5,500 $m^3$/day, or about 6,500 $m^3$/day. In other examples, the pressurized fluid can be introduced into the injection well at a rate of about 150 $m^3$/day to about 2,500 $m^3$/day, about 1000 $m^3$/day to about 4,000 $m^3$/day, about 500 $m^3$/day to about 3,300 $m^3$/day, about 750 $m^3$/day to about 6,000 $m^3$/day, or about 300 $m^3$/day to about 3,000 $m^3$/day.

The pressurized fluid can be introduced into the injection well until a desired or predetermined pressure for a particular injection well or disposal well is reached. For example, in a disposal well, the predetermined pressure that can be reached before injection of the pressurized fluid should be stopped can sometimes be limited to about 120% of the virgin reservoir pressure prior to any production of injection into the reservoir. In another example, in the formation that includes hydrocarbons disposed therein, the predetermined pressure that can be reached before injection of the pressurized fluid should be stopped can sometimes be limited to about 90% of a formation fracture pressure.

The pressurized fluid can be introduced into a single injection well or multiple injection wells. In one example, the pressurized fluid can be introduced into a first injection well that introduces the pressurized fluid into a formation that includes hydrocarbons for enhanced hydrocarbon recovery and into a second injection well that introduces the pressurized fluid into a disposal well. In another example, the pressurized fluid can be introduced into two or more injection wells that introduce the pressurized fluid into formations that include hydrocarbons for enhanced hydrocarbon recovery. In another example, the pressurized fluid can be introduced into two or more injection wells that introduce the pressurized fluid into disposal wells.

In some examples, the process for injecting the pressurized fluid into the injection well can also include holding, storing, aggregating, collecting, accumulating, or otherwise containing the fluid in a fluid storage apparatus prior to introducing the fluid into the subterranean housing. In some examples, the fluid storage apparatus can be located on the surface of the earth. In other examples, the fluid storage apparatus can be located above the surface of the earth, e.g., a tower such as water tower. As such, a bottom or lower elevation of the fluid within the fluid storage apparats can be located at the surface of the earth or above the surface of the earth.

As used herein, the term "fluid storage apparatus" refers to any container, equipment, structure, object, or other body capable of containing, at least temporarily, the fluid, e.g., water or a water-rich product, and releasing the fluid therefrom as needed to the subterranean housing that includes the pressurizing apparatus at least partially disposed therein. Illustrative fluid storage apparatus can include, but are not limited to, one or more vessels, one or more tanks, one or more earthen structures (man-made or naturally formed) such as an open pit formed into the surface of the earth, or other apparatus capable of containing the fluid. In some examples, the fluid can originate or have been previously introduced into a pond, lake, river, ocean, stream, or other natural or man-made body of water. As such, in some examples, the fluid storage apparatus can be the surface of the earth that supports a pond, lake, river, ocean, stream, or other natural or man-made body of water.

In some examples, the fluid storage apparatus can provide the fluid with a hydrostatic pressure sufficient to cause the fluid to flow into the inlet of the pressurizing apparatus. In other examples, the fluid storage device in combination with a flow path of the fluid from the fluid storage device to the inlet of the pressurizing apparatus can provide the fluid with a hydrostatic pressure sufficient to cause the fluid to flow into the inlet of the pressurizing apparatus. In still other examples, the flow path of the fluid from the fluid storage device to the inlet of the pressurizing apparatus can provide the fluid with a hydrostatic pressure sufficient to cause the fluid to flow into the inlet of the pressurizing apparatus. In at least one example, the fluid within the subterranean housing can have a hydrostatic pressure that can be sufficient to introduce the water-rich product into the inlet of the pressurizing apparatus. In another example, the hydrostatic pressure of the fluid alone can cause the fluid to flow into the inlet of the pressurizing apparatus.

In some examples, one or more charge pumps can be used to increase a pressure of the fluid prior to introducing the fluid into the subterranean housing. The charge pump can increase the pressure of the fluid prior to introduction into the subterranean housing. Illustrative commercially available charge pumps can include, but are not limited to, the 811M, 12,000 barrel per day charge pump, available from Griswold and/or the 3SS2EL, 200 gallon per minute charge pump, available from ITT Gould.

In some examples, the subterranean housing can be or can include a first container at least partially disposed within a second container. The second container (if present) can be sufficiently sized to provide a volume between an inner surface thereof and an outer surface of the first container. For example, an annular volume can be defined between an outer sidewall surface of the first container and an inner sidewall surface of the second container. In some examples, a cylindrical volume can be defined between an outer bottom wall surface of the first container and an inner bottom wall surface of the second container. The volume between the inner surface of the second container and the outer surface of the first container can remain free or substantially free of any fluid introduced into the first container. The volume between the inner surface of the second contain and the outer surface of the first container can also remain free or substantially free of any fluid disposed within the subterranean formation adjacent an exterior surface of the second container.

The volume between the inner surface of the second container and the outer surface of the first container can provide a storage area for any fluid that may leak or otherwise flow from within the first container and into the volume between the inner surface of the second container and the outer surface of the first container. In some examples, the volume between the inner surface of the second container and the outer surface of the first container can be monitored for the presence of any fluid introduced into the first container and/or any fluid disposed within the subterranean formation adjacent the exterior surface of the second container that may enter thereto. For example, one or more sensors configured or adapted to detect the presence of the fluid introduced into the first container and/or any fluid that may be disposed within the subterranean formation adjacent the second container can be disposed or otherwise located within the volume between the inner surface of the second container and the outer surface of the first container.

If any fluid introduced into the first container and/or any fluid disposed within the subterranean formation adjacent the exterior surface of the second contain enters into the volume between the inner surface of the second container and the outer surface of the first container, introduction of the fluid into the first container can be stopped and the leak can be sealed and/or the container having the leak, i.e., the first container and/or the second container can be replaced, before operations resume. As such, the second container can serve as a containment barrier that can prevent any of the fluid introduced into the first container from flowing into the subterranean formation adjacent the exterior surface of the second container. The second container can also serve as a barrier that can prevent any fluid in the subterranean formation adjacent the exterior surface of the second container from coming into contact with the exterior surface of the first container.

In some examples, the volume between the inner surface of the second container and the outer surface of the first container can be at least partially filled with one or more barrier fluids. The barrier fluid disposed within the volume between the inner surface of the second container and the outer surface of the first container can be or can include one or more gases, one or more liquids, or a mixture thereof. Illustrative barrier fluids can be or can include, but are not limited to, air; nitrogen; carbon dioxide; argon; water; an oil, e.g., one or more vegetable oils, paraffinic oils, or a mixture thereof; or any mixture thereof.

A sensor can be disposed within the volume between the inner surface of the second container and the outer surface of the first container. In some examples, the sensor can be configured or adapted to monitor a pressure of the barrier fluid. If the sensor monitoring the pressure of the barrier fluid detects a change in the pressure of the barrier fluid, the sensor can issue an alert indicating a change in pressure of the barrier fluid has occurred and the system can be idled or shut down to determine the reason for the change in pressure, e.g., a leak between the second container and a subterranean formation adjacent the second container, a leak between the first contain and the second container, or other reason the pressure of the barrier fluid may have changed.

In other examples, the volume between the inner surface of the second container and the outer surface of the first container can be at least partially filled with one or more solids. Illustrative solids can be or include, but are not limited to, cement; concrete; clay, e.g., bentonite; or any combination or mixture thereof. In other examples, the volume between the inner surface of the second container and the outer surface of the first container can be at least partially filled with a mixture of one or more barrier fluids and one or more solids.

As used herein, the term "second container" refers to any object that can be at least partially disposed below the surface of the earth and configured or adapted to hold the first container at least partially or entirely therein. The second container, similar to the first container, can have any desired cross-sectional shape. For example, the second container can have an elliptical cross-sectional shape, an oval cross-sectional shape, a polygonal cross-sectional shape, or any combination thereof. In some examples, the second container can have an elliptical cross-sectional shape, e.g., a generally circular cross-section, such as a pipe, a tube, a casing, or other elongated structure having an internal volume sized such that the first container can be at least partially disposed therein. In other examples, the second container can have a generally rectangular shape, such as a box or other elongated structure. In some examples, the second container can have a substantially similar cross-sectional shape as compared to the cross-sectional shape of the first container. In other examples the second container can have a substantially different cross-sectional shape as compared to the cross-sectional shape of the first container. In some examples, the first container and/or the second container can be made or composed of metal, polymer, fiberglass, carbon fiber, or combinations or mixtures thereof.

In some examples, when the second container has an elliptical cross-sectional shape, e.g., a generally circular cross-section, the second container can have an average cross-sectional length of about 17.8 cm, about 20.3 cm, about 22.9 cm, about 25.4 cm, about 27.9 cm, about 30.5 cm, about 33 cm, about 35.6 cm, or about 38.1 cm to about 39.4 cm, about 40.6 cm, about 43.2 cm, about 45.7 cm, about 48.3 cm, about 50.8 cm, or about 53.3 cm. For example, a second container having a generally circular cross-section can have an inner diameter of about 25.4 cm to about 53.3 cm, about 33 cm to about 50.8 cm, about 34.3 cm to about 47 cm, or about 35.6 cm to about 48.3 cm. In some examples, when the second container has an elliptical cross-sectional shape, e.g., a generally circular cross section, the second container can have a wall thickness (sidewall and/or bottom) of about 0.5 cm, about 0.6 cm, about 0.7 cm, about 0.8 cm, about 0.9 cm, or about 1 cm to about 1.1 cm, about 1.3 cm, about 1.5 cm, about 1.7 cm, about 1.8 cm, about 1.9 cm, about 2 cm, or about 2.1 cm.

In some examples, when the second container has an elliptical cross-sectional shape, the bottom end, e.g., an elliptical plate, can be sized to accommodate at least some overlap of the sidewall to allow the bottom end to be secured thereto, e.g., via a weld seam, to provide the second container with a sealed or otherwise closed bottom end. In other examples, when the second container has an elliptical cross-sectional shape, the bottom end, e.g., an elliptical cap, can be threadedly secured to an end of the first container to provide the second container with a sealed or otherwise closed bottom end. In other examples, when the second container has an elliptical cross-sectional shape, the bottom end can be integrated with an end of the second container to provide the second container with a sealed or otherwise closed bottom end. For example, the second container can be fabricated or otherwise made from fiberglass that can be formed into a single or unitary body without seams between two or more sections or pieces. It should be understood that second containers having other cross-sectional shapes, i.e., non-elliptical cross-sectional shape, can have bottom ends shaped appropriately to provide the first container with a sealed or otherwise closed bottom end. In other examples, the first end of the second container can be crimped, squeezed and welded, plugged, or otherwise sealed.

FIG. 1 depicts an illustrative system 100 for injecting a pressurized fluid via line 140 into an injection well 145, the system 100 including a pressurizing apparatus 125 at least partially disposed within a subterranean housing or container 115, the pressurizing apparatus 125 having an inlet 126 disposed within the container 115 and below a surface 133 of the earth, according to one or more embodiments. The container 115 can include one or more inlets 116 for introducing a fluid thereto, an inner sidewall surface 117, an outer sidewall surface 118, a first or bottom end 119, and a second or top end 120. The pressurizing apparatus 125 can include the inlet 126, an outlet 127, and an outer surface 128. The inlet 126 of the pressurizing apparatus 125 can be disposed below the outlet 127 of the pressurizing apparatus 125. In some examples, the inlet 126 of the pressurizing apparatus 125 can be disposed substantially beneath or substantially axially below the outlet 127 of the pressurizing apparatus 125.

In some examples, a longitudinal axis of the pressurizing apparatus 125 can be substantially vertical with respect to the surface 133 of the earth adjacent the container 115. For example, when the longitudinal axis of the pressurizing apparatus 125 is substantially vertical with respect to the surface 133 of the earth, an angle between the longitudinal axis of the pressurizing apparatus 125 and the surface 133 of the earth can be about 85°, about 86°, about 87°, about 88°, or about 89° to about 91°, about 92°, about 93°, about 94°, or about 95°.

The container 115 can have any desired cross-sectional shape. For example, the container 115 can have an elliptical cross-sectional shape, an oval cross-sectional shape, a polygonal cross-sectional shape, or any combination thereof. In some examples, the container 115 can have an elliptical cross-sectional shape, e.g., a substantially circular cross-sectional shape, such as a pipe, a tube, a casing, or other elongated structure, and can have an internal volume sized such that the pressurizing apparatus 125 can be at least partially disposed therein. In other examples, the container 115 can have a substantially rectangular shape, such as a box or other elongated structure, and can have an internal volume sized such that the pressurizing apparatus 125 can be at least partially disposed therein.

In some examples, the container 115 can have an elliptical cross-sectional shape, e.g., a substantially circular cross-section, that can have an average cross-sectional length of about 12.7 cm, about 15.2 cm, about 17.8 cm, about 20.3 cm, about 22.9 cm, or about 25.4 cm to about 27.9 cm, about 30.5 cm, about 33 cm, about 35.6 cm, or about 38.1 cm. For example, when the container 115 has a substantially circular cross-section, the container 115 can have an inner diameter of about 12.7 cm to about 38.1 cm, about 25.4 cm to about 30.5 cm, about 17.8 cm to about 27.9 cm, about 22.9 cm to about 33 cm, or about 20.3 cm to about 35.6 cm. In some examples, the container 115 can have a wall thickness (the first end 119, the second end 120, and/or the sidewall, i.e., the thickness between the inner sidewall surface 117 and the outer sidewall surface 118) of about 0.5 cm, about 0.6 cm, about 0.7 cm, about 0.8 cm, about 0.9 cm, or about 1 cm to about 1.1 cm, about 1.3 cm, about 1.5 cm, about 1.7 cm, about 1.8 cm, about 1.9 cm, about 2 cm, or about 2.1 cm. The bottom end 119 of the container 115 can be sealed or otherwise closed to reduce or prevent the likelihood of any fluid introduced thereto from flowing into a subterranean formation adjacent the container 115.

In some examples, the container 115 can have a length from the first end 119 to the second end 120 of about 6 m, about 7.5 m, about 9 m, about 10.5 m, about 12 m, about 13.5 m, or about 15 m to about 16.5 m, about 18 m, about 19.5 m, about 21 m, about 23 m, about 24.5 m, about 26 m, about 27 m, about 29 m, about 30.5 m, or greater. In some examples, the container 115 can be assembled from a plurality of segments or sections, e.g., a plurality of casing sections, which can be threadedly connected to one another, welded to one another, or otherwise secured to one another to make a container 115 having a desired or predetermined length from the first end 119 to the second end 120. In some examples, the container 115 can be fabricated or made of fiberglass and can that can be formed into a single body without seams between two or more sections or pieces.

In some examples, the inner cross-sectional length, e.g., diameter, of the container 115 can be sized according to one or more process variables. Illustrative process variables that can be used to determine the inner cross-sectional length of the container 115 can be or can include, but are not limited to, a desired or predetermined flow rate of the fluid introduced via line 140 into the inlet 116 of the container 115, a desired or predetermined flow rate of the fluid introduced from within the container 115 into the inlet 126 of the pressurizing apparatus 125, a composition or expected composition of the fluid to be introduced into the inlet 116 of the pressurizing apparatus 125, an outer cross-sectional length, e.g., diameter, of the pressurizing apparatus 125, a length from the first end 119 to the second end 120 of the container 115, the volume 112 within the container 115 available to contain or hold the fluid in line 101 introduced thereto via inlet 116, or any combination thereof.

The fluid can be a gas, a liquid, or a multi-phase gas and liquid mixture. In some examples, the fluid can be or can include water. In other examples, the fluid can include water; one or more salts; algae; fungi; bacteria; dissolved gases, e.g., oxygen, carbon dioxide, and/or hydrogen sulfide; entrained hydrocarbons; entrained solid or particulate matter; or any mixture thereof. In some examples, the fluid can be a filtrate, chemically treated, and/or have undergo other processing to produce a fluid having a desired or predetermined composition. For example, if the fluid includes an undesirable amount of solids, the solids content can be reduced by filtering, centrifugal separation, and/or other processing.

The fluid can be any one or more gases, one or more liquids, or combinations thereof. The fluid, for example, can be a multi-phase gas and liquid mixture. In some examples, the fluid can be or can include water. In other examples, the fluid can include water; one or more salts; algae; fungi; bacteria; dissolved gases, e.g., oxygen, carbon dioxide, and/or hydrogen sulfide; entrained hydrocarbons; entrained solid or particulate matter; or any mixture thereof. In some examples, the fluid can be salt water. In some examples, the fluid can be a filtrate, chemically treated, and/or have undergone other processing to produce a fluid having a desired or predetermined composition. If the fluid includes an undesirable amount of solids, the solids content can be reduced by filtering, centrifugal separation, settling, and/or other processing known in the art.

In some examples, the fluid can be or can include a water-rich product separated from a hydrocarbon production fluid that can also be referred to as "produced water". The particular composition of the water-rich product can widely vary and can depend, at least in part, on the particular hydrocarbon production fluid from which the water-rich product was separated. In some examples, the water-rich product can be a mixture of water and dissolved and/or particulate organic material and/or dissolved and/or particulate inorganic material that can include essentially freshwater to concentrated saline brines.

The fluid in line 101 can flow from the inlet 116 and into the volume or space 112 located between the inner sidewall surface 117 of the container 115 and the outer surface 128 of the pressurizing apparatus 125. The fluid can flow into the inlet 126 of the pressurizing apparatus 125, can be pressurized within the pressurizing apparatus 125, and the pressurized fluid can be recovered via line 140 from the outlet 127 of the pressurizing apparatus 125. The pressurizing apparatus 125 can be or can include any pump or other device, system, equipment, apparatus, or any combination thereof configured or adapted to increase a pressure of or to lift the fluid introduced into the inlet 126 of the pressurizing apparatus 125 to the outlet 127 of the pressurizing apparatus 125. Illustrative pressurizing apparatus can be or can include, but are not limited to, one or more vertical submersible pumps.

The pressurized fluid via line 140 can be introduced into an inlet 146 of the injection well 145. In some examples, the injection well 145 can include, but is not limited to, an inner body 150 and an outer body 155. In some examples, the inner body 150 and/or the outer body 155 can be or can include one or more conduits, pipes, tubes, casings, or other elongated structure(s) having a volume therein. The inner body 150 and the outer body 155 can be sized such that the inner body 150 can be at least partially disposed within the outer body 155. In some examples, a first or bottom end 156 of the outer body 155 can be open and the pressurized fluid can exit an outlet 147 of the inner body 150 and flow into the subterranean formation adjacent the first end 156 of the outer body 155. It should be noted that the first end of the outer body 155 can be sealed and one or more perforations can be disposed through the sidewall of the outer body 155 and/or the sealed end of the outer body 155.

In some examples, the pressurized fluid that exits the outlet 147 of the inner body 150 can be introduced into a subterranean formation that can include hydrocarbons disposed therein. In such example, the introduction of the pressurized fluid into the subterranean formation can increase or enhance the recovery of the hydrocarbons from the formation from a hydrocarbon production well (not shown). In other examples, the pressurized fluid that exits the outlet 147 of the inner body 150 can be introduced into a disposal well that can contain the pressurized fluid. For example, the disposal well can have an impermeable cap formation and an impermeable base formation capable of containing the pressurized fluid therein. In other examples, the pressurized fluid can be introduced into multiple injection wells 145 and each injection well 145 can independently introduce the pressurized fluid into one or more subterranean formations that can include hydrocarbons disposed therein, one or more disposal wells, or a combination thereof.

Figure 2:
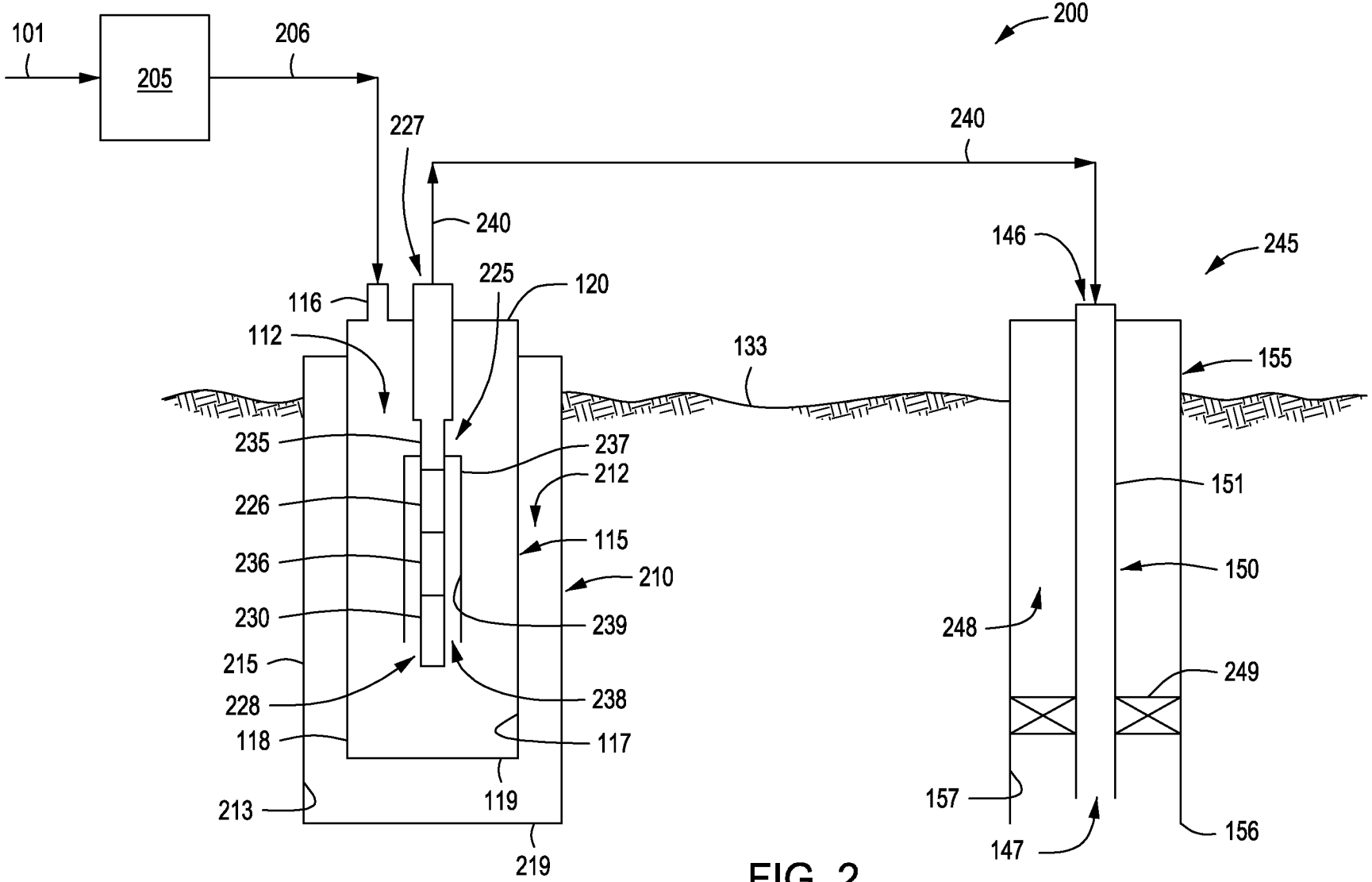
FIG. 2 depicts another illustrative system for injecting a fluid into a well that includes a vertical submersible pump at least partially disposed within a subterranean housing, the vertical submersible pump having an inlet disposed within the subterranean housing and below the surface of the earth, according to one or more embodiments described.

FIG. 2 depicts another illustrative system 200 for injecting a pressurized fluid via line 240 into an injection well 245, the system including a pressuring apparatus or vertical submersible pump 225 at least partially disposed within a container 115 and having an inlet 226 below the surface 133 of the earth, according to one or more embodiments. In some examples, the system 200 can also include one or more fluid storage apparatus 205 and one or more containers or "second containers" 210. The container or "first container" 115 can be at least partially disposed within the second container 210. In this example, the subterranean housing can include the first container 115 at least partially disposed within the second container 210.

In some examples, prior to introducing the fluid in line 101 into the first container 115, the fluid via line 101 can be introduced into the fluid storage apparatus 205. The fluid storage apparatus 205 can be configured or adapted to hold, store, aggregate, collect accumulate, or otherwise contain the fluid within the fluid storage apparatus 205, at least temporarily, prior to introducing the fluid via inlet 116 into the first container 115. In some examples, the fluid storage apparatus 205 can be located on the surface 133 of the earth. In other examples, the fluid storage apparatus 205 can be located above the surface 133 of the earth, e.g., in a tower. As such, a bottom or lower elevation of the fluid within the fluid storage apparats can be located at the surface 133 of the earth or above the surface 133 of the earth.

Illustrative fluid storage apparatus 205 can include, but are not limited to, one or more vessels, one or more tanks, one or more earthen structures (man-made or naturally formed) such as an open pit formed into the surface of the earth, or other apparatus capable of containing the fluid. In some examples, the fluid can originate or have been previously introduced into a pond, lake, river, ocean, stream, or other natural or man-made body of water. As such, in some examples, the fluid storage apparatus 205 can be the surface 133 of the earth that supports a pond, lake, river, ocean, stream, or other natural or man-made body of water.

The fluid via line 206 can be introduced from the fluid storage apparatus 205 into the inlet 116 of the first container 115. The fluid can flow through the volume 112 between the inner surface 117 of the first container 115 and an outer surface 228 of the vertical submersible pump 225 and into the inlet 226 of the vertical submersible pump 225. The vertical submersible 225 pump can include, but is not limited to, the inlet 226, an outlet 227, a motor 230, and a pump 235. In some examples, the motor 230 can be disposed toward or at a first end of the vertical submersible pump 225, the outlet 227 can be disposed toward or at a second end of the vertical submersible pump 225, the pump 235 can be disposed adjacent the outlet 227, and the inlet 226 can be disposed between the pump 235 and the motor 230. The inlet 226 of the vertical submersible pump 225 can be located below the outlet 227 of the vertical submersible pump 225. In some examples, the inlet 226 of the vertical submersible pump 225 can be located beneath or axially below the outlet 227 of the vertical submersible pump 225. The pump 235 of the vertical submersible pump 225 can be sized and can include any number of stages or bowls such that, during operation, the pressurized fluid via line 240 can be recovered from the vertical submersible pump 225 at a predetermined or otherwise desired flow rate and at a predetermined or otherwise desired pressure. It should be understood that a shaft or other body can mechanically link or connect the motor 230 with the pump 235 that can be rotated or otherwise moved during operation to drive the pump 235.

In some examples, the vertical submersible pump 225 can also include one or more optional seals 236. In such example, the motor 230 can be disposed toward or at the first end of the vertical submersible pump 225, the outlet 227 can be disposed toward or at the second end of the vertical submersible pump 225, the seal 236 can be disposed adjacent the motor 230, the pump 235 can be disposed adjacent the outlet 227, and the inlet 226 can be disposed between the seal 236 and the pump 235. The seal 236 can prevent or reduce the likelihood of any of the fluid from flowing into the motor 230 during operation of the vertical submersible pump 225. In some examples, the motor 230, seal 236 (if present), the inlet 226, the pump 235, and the outlet 227 can be substantially axially aligned with respect to one another. In some examples, a longitudinal axis of the vertical submersible pump 225 can be substantially vertical with respect to the surface 133 of the earth adjacent the second container 210.

In some examples, the vertical submersible pump 225 can also include one or more optional shrouds 237. In some examples, the shroud 237 can be disposed about the inlet 226, the seal 236 (if present), and at least a portion of the motor 230 such that a flow path 238 can be formed between an inner surface 239 of the shroud 237 and the outer surface 228 of the vertical submersible pump 225. For example, the flow path 238 can be formed between at least a portion of the outer surface of the motor 230, the seal 236 (if present), and the inlet 226. As such, the shroud 237 can be configured or adapted to direct the fluid downward through the volume 112 into the first container 115 and the fluid can flow upward through the flow path 238 between the shroud 237 and at least a portion of the motor 230 and the seal 236 (if present) and into the inlet 226 of the vertical submersible pump 225. Flowing the fluid between the shroud 237 and at least a portion of the motor 230 and into the inlet 226 can cool the motor 230 during operation, thus preventing or reducing the tendency of the motor 230 to overheat during operation of the vertical submersible pump 225.

In some examples, the fluid storage apparatus 205 can provide the fluid with a hydrostatic pressure sufficient to cause the fluid from the fluid storage apparatus 205 to flow into the inlet 226 of the vertical submersible pump 225. In other examples, the fluid storage apparatus 205 in combination with a flow path of the fluid from the fluid storage apparatus 205 to the inlet 226 of the vertical submersible pump 225 can provide a hydrostatic pressure on the fluid that can be sufficient to cause the fluid to flow into the inlet 226 of the vertical submersible pump 225. In still other examples, the flow path of the fluid from the fluid storage apparatus 205 to the inlet 226 of the vertical submersible pup 225 can provide a hydrostatic pressure on the fluid that can be sufficient to cause the fluid to flow into the inlet 226 of the vertical submersible pump 225. In at least one example, a hydrostatic pressure on the fluid within the first container 115 can be sufficient to introduce the fluid into the inlet 226 of the vertical submersible pump 225. In another example, the hydrostatic pressure on the fluid alone can cause the fluid to flow into the inlet 226 of the vertical submersible pump 225.

In some examples, the second container 210 can be sized to provide a volume 212 between an inner surface 213 of the second container 210 and the outer surface 118 of the first container 115. In some examples, the volume 212 can remain free or substantially free of any of the fluid introduced into the first container 115. The volume 212 can also remain free or substantially free of any fluid disposed within a subterranean formation adjacent an exterior surface 215 of the second container 210. In some examples, the volume 212 can be filled or at least partially filled with one or more materials. Illustrative materials can be or can include, but are not limited to, cement; concrete; clay, e.g., bentonite; or any combination or mixture thereof. At least partially filling the volume 212 can provide a reinforced barrier about the first container 115 that can prevent or reduce a likelihood that any fluid introduced into the first container 115 and/or any fluid in the subterranean formation adjacent the exterior surface 215 of the second container 210 could flow into the volume 212.

In some examples, the volume 212 between the inner surface 213 of the second container 210 and the outer surface 118 of the first container 115 can be monitored for the presence of any fluid introduced into the first container 115 and/or any fluid disposed within the subterranean formation adjacent the exterior surface 215 of the second container 210 that may enter thereto.

In some examples, the second container 210, similar to the first container 115, can have any desired cross-sectional shape. For example, the second container 210 can have an elliptical cross-sectional shape, an oval cross-sectional shape, a polygonal cross-sectional shape, or any combination thereof. In some examples, the second container 210 can have an elliptical cross-sectional shape, e.g., a substantially circular cross-section, such as a pipe, a tube, a casing, or other elongated structure having an internal volume sized such that the first container 115 can be at least partially disposed therein. In other examples, the second container 210 can have a generally rectangular shape, such as a box or other elongated structure having a volume therein. In some examples, the second container 210 can have a substantially similar cross-sectional shape as compared to the cross-sectional shape of the first container 115. In other examples, the second container 210 can have a substantially different cross-sectional shape as compared to the cross-sectional shape of the first container 115.

In some examples, when the second container 210 has an elliptical cross-sectional shape, the second container 210 can have an average cross-sectional length of about 17.8 cm, about 20.3 cm, about 22.9 cm, about 25.4 cm, about 27.9 cm, about 30.5 cm, about 33 cm, about 35.6 cm, or about 38.1 cm to about 39.4 cm, about 40.6 cm, about 43.2 cm, about 45.7 cm, about 48.3 cm, about 50.8 cm, or about 53.3 cm. For example, a second container 210 having a substantially circular cross-section can have an inner diameter of about 25.4 cm to about 53.3 cm, about 33 cm to about 50.8 cm, about 34.3 cm to about 47 cm, or about 35.6 cm to about 48.3 cm. In some examples, the second container 210 can have a wall thickness (sidewall and/or bottom) of about 0.5 cm, about 0.6 cm, about 0.7 cm, about 0.8 cm, about 0.9 cm, or about 1 cm to about 1.1 cm, about 1.3 cm, about 1.5 cm, about 1.7 cm, about 1.8 cm, about 1.9 cm, about 2 cm, or about 2.1 cm.

In some examples, when the second container 210 has an elliptical cross-sectional shape, a bottom end 219, e.g., an elliptical plate, can be sized to accommodate at least some overlap of the sidewall to allow the bottom end 219 to be secured thereto, e.g., via a weld seam, to provide the second container 210 with a sealed or otherwise closed bottom end 219. In other examples, when the second container 210 has an elliptical cross-sectional shape, the bottom end, e.g., an elliptical cap, can be threadedly secured to the outer surface 215 of the second container 210 to provide the second container 210 with a sealed or otherwise closed bottom end 219. In other examples, when the second container 210 has an elliptical cross-sectional shape, the bottom end 219 can be integrated with an end of the sidewall to provide the second container with a sealed or otherwise closed bottom end. For example, the second container 210 can be fabricated or otherwise made from fiberglass that can be formed into a single body without seams between two or more sections or pieces. It should be understood that second containers 210 having other cross-sectional shapes, i.e., non-elliptical cross-sectional shape, can have bottom ends shaped appropriately to provide the second container with a sealed or otherwise closed bottom end 210. In other examples, the first end 219 of the second container 210 can be crimped, squeezed and welded, plugged, or otherwise sealed.

The pressurized fluid via line 240 can be introduced into an inlet 146 of the injection well 245. The injection well 245 can be similar to the injection well 145 discussed and described above with reference to FIG. 1. In some examples, the injection well 245 can also include one or more sealing elements 249 that can provide a fluid tight seal or a substantially fluid tight seal between an outer surface 151 of the inner body 150 and an inner surface or inner sidewall 157 of the outer body 155. The sealing element 249 can prevent or reduce the likelihood of any pressurized fluid exiting from the outlet 147 of the inner body 150 from flowing toward the surface 133 of the earth in the volume 248 between the inner body 150 and the outer body 155. Illustrative sealing elements 249 can be or can include, but are not limited to, one or more packers; cement; concrete; clay, e.g., bentonite; or any combination or any mixture thereof.

The pressurized fluid that exits the outlet 147 of the inner body 150 can be introduced into a subterranean formation that can include hydrocarbons disposed therein, into a disposal well that can contain the pressurized fluid, and/or into another subterranean formation. In some examples, the pressurized fluid via line 240 can be introduced into multiple injection wells 245 and each injection well 245 can independently introduce the pressurized fluid into one or more subterranean formations that can include hydrocarbons disposed therein, one or more disposal wells, or a combination thereof.

Figure 3:
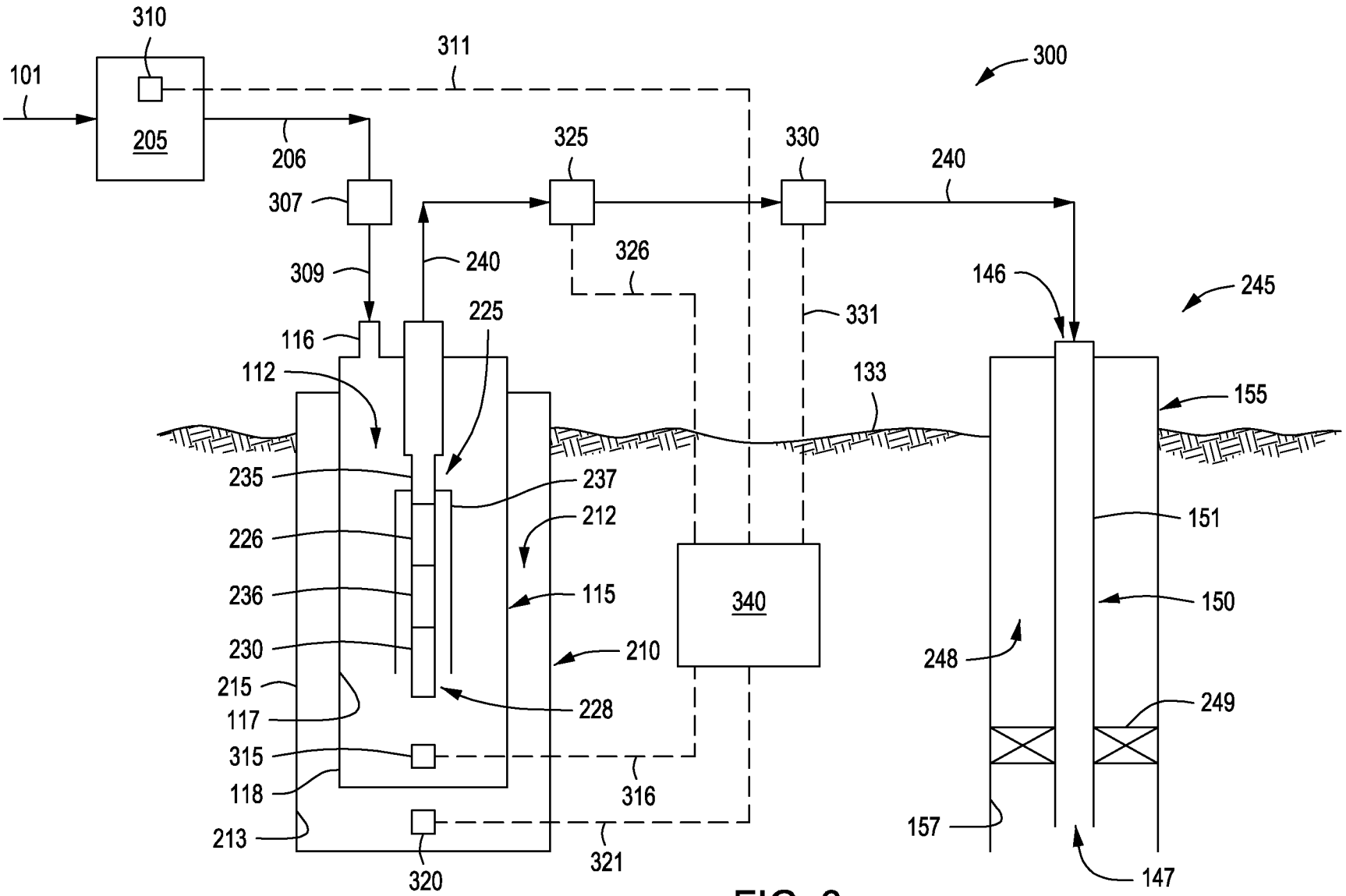
FIG. 3 depicts the system shown in FIG. 2, further including a charge pump, a plurality of sensors, and an operations module that can be configured to monitor and/or control the system, according to one or more embodiments described.

FIG. 3 depicts yet another illustrative system 300 for injecting a pressurized fluid via lie 340 into an injection well 245, the system 300 including the vertical submersible pump 225 at least partially disposed within first the container 115 and a plurality of sensors (five are shown, 310, 315, 320, 325, and 330) configured to monitor and/or control one or more operational parameters of the system 300 during operation thereof via a control unit 340, according to one or more embodiments. The system 300 can also include one or more optional charge pumps 307. As such, in some examples, the fluid via line 206 from the fluid storage apparatus 205 can be introduced to the charge pump 307, which can produce a first pressurized fluid via line 309. The first pressurized fluid via line 309 can be introduced via inlet 116 to the first container 115. It should be understood that the charge pump 307 is optional and the fluid via line 206 can be introduced from the fluid storage apparatus 205 to the inlet 116 of the first container 115.

In some examples, the sensor 310 can be configured or adapted to monitor a level of the fluid within the fluid storage apparatus 205. The sensor 310 can communicate with the control unit 340 via pathway 311. In some examples, should the fluid level within the fluid storage apparatus 205 fall to a level lower than a predetermined level, the sensor 310 can communicate the fluid level to the control unit 340 and appropriate action can be taken. For example, the control unit 340 can issue an alert, e.g., visual, audible, electronic, or the like that can alert one or more personnel that the fluid level within the fluid storage apparatus 205 has fallen below the predetermined level. In another example, the control unit 340 can shut the system 300 down, reduce an operational speed of the vertical submersible pump 225 so that less fluid from the fluid storage apparatus 205 is required, and/or other remedial measures can be taken.

In some examples, the sensor 315 can monitor the volume 112 between the inner surface 117 of the first container and the outer surface 228 of the vertical submersible pump 225. For example, the sensor 315 can monitor a temperature, a pressure, a composition, or any other property or combination of properties of the fluid introduced thereto. In some examples, the sensor 315 can communicate information, e.g., a temperature or pressure of the fluid, via pathway 316 to the control unit 340.

In some examples, the sensor 320 can monitor the volume 212 between the outer surface 118 of the first container 115 and the inner surface 213 of the second container 210. In one example, the sensor 320 can monitor the volume 212 for the presence of any fluid introduced into volume 112 within the first container 115. In another example, the sensor 320 can monitor the volume 212 for the presence of any fluid that may enter thereto from the subterranean formation adjacent the exterior surface 215. In other examples, the sensor 320 can monitor the volume 21 for the presence of any fluid introduced into volume 112 within the first container 115 and for the presence of any fluid that may enter thereto from the subterranean formation adjacent the exterior surface 215. In some examples, if the sensor detects the presence of any fluid from the first container 115 and/or any fluid from the subterranean formation within the volume 212, the sensor 320 can communicate such presence via pathway 321 to the control unit 340 and appropriate action can be taken. For example, the control unit 340 can issue an alert, e.g., visual, audible, electronic, or the like that can alert one or more personnel that a fluid, e.g., any fluid, the fluid within the first container, or a fluid from the subterranean formation adjacent the second container 210, has been detected within the volume 212. In another example, the control unit 340 can shut the system 300 down.

In some examples, the sensor 325 can be configured or adapted to monitor a pressure and/or a temperature of the pressurized fluid in line 240. The sensor 325 can communicate via pathway 326 with the control unit 340. In some examples, should the pressure of the pressurized fluid in line 240 fall below a pre-determined minimum pressure and/or increase above a pre-determined maximum pressure, the sensor 325 can communicate the pressure of the pressurized fluid in line 240 to the control unit 340 and appropriate action can be taken. In other examples, should the temperature of the pressurized fluid in line 240 fall below a pre-determined minimum temperature and/or increase above a pre-determined maximum temperature, the sensor 325 can communicate the temperature of the pressurized fluid in line 240 to the control unit 340 and appropriate action can be taken. In some examples, the control unit can shut down the system 300, reduce or increase an operational speed of the variable submersible pump 225, close or open one or more flow restriction devices (not shown) in line 206, and/or initiate any other operational change according to a predetermined response strategy.

In some examples, the sensor 330 can be configured or adapted to monitor a flow rate of the pressurized fluid in line 240. The sensor 330 can communicate via pathway 331 with the control unit 340. In some examples, should the flow rate of the pressurized fluid in line 240 fall below a pre-determined minimum flow rate and/or increase above a pre-determined maximum flow rate, the sensor 330 can communicate the flow rate of the pressurized fluid in line 240 to the control unit 340 and appropriate action can be taken. In some examples, the control unit can shut down the system 300, reduce or increase an operational speed of the variable submersible pump 225, close or open one or more flow restriction devices (not shown) in line 206, and/or initiate any other operational change according to a predetermined response strategy.

It should be understood that the control unit 340, in response to any communication(s) from any one or more of the sensors 310, 315, 320, 325, and/or 330, can be configured or adapted to proceed according to a predetermined response that can be configured based on any one or more of a variety of factors that can vary from injection well to injection well. Accordingly, the control system 340 in combination with any one or more of the sensors 310, 315, 320, 325, and/or 330 can be configured or adapted to function in a predetermined manner that can take the most appropriate action(s) for a given injection well.

It should also be understood that any one or more of the sensors 310, 315, 320, 325, and/or 330 can continuously communicate with the control unit 340, communicate with the control unit 340 at predetermined time intervals, or only when a sensor detects or measures a value falling within a predetermined range, e.g., a flowrate that falls below a minimum flow rate or increases above a maximum flow rate.

The communication between the sensors 310, 315, 320, 325, and/or 330 via pathways 311, 316, 321, 326, and/or 331 can be hardline or hard wired connections, wireless connections, optical connections, acoustical connections, or any combination thereof. The control unit 340 and/or the sensors 310, 315, 320, 325, and/or 330 can be powered via any known power source. For example, the power source can be or can include one or more power supplies utilizing one or more batteries, one or more power supplies utilizing electricity provided by one or more electrical cables, and/or any known power source capable of delivering power.

The control unit 340 can operate using any desired platform. For example, the control unit 340 can be or can include any device that has computing and/or electronic memory capability. These devices can be or can include, but are not limited to and are presented for illustrative purposes only, computers, storage devices with memory, distributed computer networks, or any other device or system upon which a user can store data and/or execute a software program. One or more operating systems can be stored on the memory. The operating system can facilitate control and execution of software using the control unit 340. Any of the available operating systems may be used in this manner including WINDOWS, LINUX, ANDROID, APPLE IOS, APPLE OS, UNIX, related server operating system versions of each respective operating system, customer operating systems, and the like. In some examples, the control unit 340 can execute software algorithms. The software algorithms can be utilized to analyze data communicated thereto by one or more of the sensors 310, 315, 320, 325, and/or 330.

Suitable memory devices include without limitation, and for illustrative purposes only: hard drives, disk drives such as digital video disk and/or compact disk drives, random access memory, read only memory, electronically erasable programmable read only memory, tape drives, flash memory, thumb drives, mini-drives, micro-drives, and any other memory device. Those skilled in the art are familiar with the many variations that can be employed using memory devices and no limitations should be imposed on the embodiments described herein due to memory device configurations and/or algorithm prosecution techniques.

Embodiments of the present disclosure further relate to any one or more of the following paragraphs:

1. A process for injecting into an injection well, comprising: introducing a water-rich product separated from a hydrocarbon production fluid comprising a hydrocarbon and water into a fluid storage apparatus; introducing the water-rich product from the fluid storage apparatus into a subterranean housing comprising a pressurizing apparatus at least partially disposed therein, wherein the subterranean housing is at least partially disposed under a surface of the earth, and wherein the pressurizing apparatus has an inlet located within the subterranean housing and below the surface of the earth; introducing the water-rich product from the subterranean housing into the inlet of the pressurizing apparatus; and introducing a pressurized water-rich product from an outlet of the pressurizing apparatus into an injection well.

2. The process according to paragraph 1, wherein the inlet of the pressurizing apparatus is located below the outlet of the pressurizing apparatus.

3. The process according to paragraph 1 or 2, wherein the inlet of the pressurizing apparatus is located beneath the outlet of the pressurizing apparatus.

4. The process according to any one of paragraphs 1 to 3, wherein a longitudinal axis of the pressurizing apparatus is substantially vertical.

5. The process according to any one of paragraphs 1 to 4, wherein a hydrostatic pressure of the water-rich product within the subterranean housing is sufficient to introduce the water-rich product into the inlet of the pressurizing apparatus.

6. The process according to any one of paragraphs 1 to 4, wherein a hydrostatic pressure of the water-rich product within the subterranean housing causes the introduction of the water-rich product from the subterranean housing into the inlet of the pressurizing apparatus.

7. The process according to any one of paragraphs 1 to 6, wherein a charge pump increases a pressure of the water-rich product from the fluid storage apparatus prior to introducing the water-rich product from the fluid storage apparatus into the subterranean housing.

8. The process according to any one of paragraphs 1 to 7, wherein the subterranean housing comprises a first container at least partially disposed within a second container.

9. The process according to paragraph 8, wherein a substantially annular volume is defined between an outer sidewall surface of the first container and an inner sidewall surface of the second container.

10. The process according to paragraph 8 or 9, wherein a substantially cylindrical volume is formed between an outer bottom wall surface of the first container and an inner bottom wall surface of the second container.

11. The process according to paragraph 9 or 10, wherein a sensor configured to detect a presence of the fluid is disposed within the substantially annular volume or the substantially cylindrical volume.

12. The process according to paragraph 9 or 10, wherein a sensor configured to detect a presence of a formation fluid introduced thereto from a subterranean formation location adjacent the second container is disposed within the substantially annular volume or the substantially cylindrical volume.

13. The process according to paragraph 9 or 10, wherein a barrier fluid is disposed within the substantially annular volume, the substantially cylindrical volume, or both, and wherein a sensor configured to detect a change in pressure of the barrier fluid is disposed within the substantially annular volume or the substantially cylindrical volume.

14. The process according to paragraph 13, wherein the barrier fluid comprises a gas, a liquid, or a mixture of a gas and a liquid.

15. The process according to any one of paragraphs 1 to 14, further comprising monitoring a flow rate of the water-rich product from the fluid storage apparatus into the subterranean housing or first container; and adjusting the flow rate of the water-rich product to maintain a pre-determined flow rate of the water-rich product into the inlet of the pressurizing apparatus.

16. The process according to any one of paragraphs 1 to 15, further comprising monitoring an amount of fluid in the fluid storage apparatus and adjusting the amount of fluid in the fluid storage apparatus to maintain a pre-determined flow rate of the water-rich product into the inlet of the pressurizing apparatus.

17. The process according to any one of paragraphs 1 to 16, wherein the fluid storage apparatus is located above the surface of the earth.

18. The process according to any one of paragraphs 1 to 17, wherein an elevation of the water-rich product in the fluid storage apparatus provides the water-rich product with a sufficient hydrostatic pressure to cause the water-rich product to flow into the inlet of the pressurizing apparatus.

19. The process according to any one of paragraphs 1 to 18, further comprising adjusting a flow rate of the water-rich product introduced from the subterranean housing or first container into the inlet of the pressurizing apparatus.

20. The process according to any one of paragraphs 1 to 19, further comprising adjusting a flow rate of the water-rich product introduced from the subterranean housing or first container into the inlet of the pressurizing apparatus by varying an operational speed of the pressurizing apparatus.

21. The process according to any one of paragraphs 1 to 20, further comprising adjusting a flow rate of the pressurized water-rich product from the outlet of the pressurizing apparatus into the injection well.

22. The process according to any one of paragraphs 1 to 21, further comprising adjusting a flow rate of the pressurized water-rich product from the outlet of the pressurizing apparatus into the injection well by varying an operational speed of the pressurizing apparatus.

23. The process according to any one of paragraphs 1 to 22, further comprising monitoring a vibration of the pressurizing apparatus, and automatically shutting the pressurizing apparatus off if the vibration exceeds a pre-determined value.

24. The process according to any one of paragraphs 1 to 22, wherein a vibration of the pressurizing apparatus is not monitored.

25. The process according to any one of paragraphs 1 to 24, wherein the pressurizing apparatus is a vertical submersible pump.

26. The process according to any one of paragraphs 1 to 24, wherein the pressurizing apparatus is a vertical submersible pump comprising the outlet, a rotating component, the inlet, and a motor, wherein: the motor is located at a first end of the pressurizing apparatus, the outlet is located at a second end of the apparatus, the rotating component is located adjacent the outlet, and the inlet is located between the motor and the rotating component.

27. The process according to any one of paragraphs 1 to 24, wherein the pressurizing apparatus is a vertical submersible pump comprising the outlet, a rotating component, the inlet, a seal, and a motor, wherein: the motor is located at a first end of the pressurizing apparatus, the outlet is located at a second end of the apparatus, the rotating component is located adjacent the outlet, the seal is located adjacent the motor, and the inlet is located between the seal and the rotating component.

28. The process according to any one of paragraphs 1 to 24, wherein the pressurizing apparatus is a vertical submersible pump comprising the outlet, a rotating component, the inlet, a seal, a motor, and a shroud, wherein: the motor is located at a first end of the pressurizing apparatus, the outlet is located at a second end of the apparatus, the rotating component is located adjacent the outlet, the seal is located adjacent the motor, the inlet is located between the seal and the rotating component, and the shroud is disposed about the inlet, the seal, and at least a portion of the motor such that the fluid within the subterranean housing flows between an exterior surface of the at least a portion of the motor, an exterior surface of the seal, and into the inlet.

29. The process according to any one of paragraphs 1 to 28, wherein the pressurized water-rich product is at a pressure of about 6.5 MPa, to about 35 MPa.

30. A system for injecting water into an injection well, comprising: a fluid storage apparatus configured to store a water-rich product separated from a hydrocarbon production fluid; a subterranean housing comprising a pressurizing apparatus at least partially disposed therein, wherein the subterranean housing is at least partially disposed under a surface of the earth, wherein the pressurizing apparatus comprises an inlet located within the subterranean housing and below the surface of the earth, and wherein the pressurizing apparatus comprises an outlet configured to eject a pressurized water-rich product therefrom; and an injection well configured to introduce the pressurized water-rich product into a subterranean formation.

31. The system according to paragraph 30, wherein the subterranean formation comprises one or more hydrocarbons.

32. The system according to paragraph 30, wherein the subterranean formation is a disposal well.

33. The system according to any one of paragraphs 30 to 32, wherein the inlet of the pressurizing apparatus is located below the outlet of the pressurizing apparatus.

34. The system according to any one of paragraphs 30 to 33, wherein the inlet of the pressurizing apparatus is located below the outlet of the pressurizing apparatus.

35. The system according to any one of paragraphs 30 to 34, wherein a longitudinal axis of the pressurizing apparatus is substantially vertical.

36. The system according to any one of paragraphs 30 to 35, further comprising a charge pump configured to increase a pressure of the water-rich product from the fluid storage apparatus.

37. The system according to any one of paragraphs 30 to 36, wherein the subterranean housing comprises a first container at least partially disposed within a second container.

38. The system according to paragraph 37, wherein a substantially annular volume is defined between an outer sidewall surface of the first container and an inner sidewall surface of the second container.

39. The system according to paragraph 37 or 38, wherein a substantially cylindrical volume is formed between an outer bottom wall surface of the first container and an inner bottom wall surface of the second container.

40. The system according to paragraph 38 or 39, wherein a sensor configured to detect a presence of the fluid is disposed within the substantially annular volume or the substantially cylindrical volume.

41. The system according to paragraph 38 or 39, wherein a sensor configured to detect a presence of a formation fluid introduced thereto from a subterranean formation location adjacent the second container is disposed within the substantially annular volume or the substantially cylindrical volume.

42. The system according to paragraph 38 or 39, wherein a barrier fluid is disposed within the substantially annular volume, the substantially cylindrical volume, or both, and wherein a sensor configured to detect a change in pressure of the barrier fluid is disposed within the substantially annular volume or the substantially cylindrical volume.

43. The system according to paragraph 42, wherein the barrier fluid comprises a gas, a liquid, or a mixture of a gas and a liquid.

44. The system according to any one of paragraphs 30 to 43, further comprising a sensor configured to monitor a flow rate of the water-rich product from the fluid storage apparatus into the subterranean housing.

45. The system according to any one of paragraphs 30 to 44, further comprising a sensor configured to monitor an amount of the water-rich product in the fluid storage apparatus.

46. The system according to any one of paragraphs 30 to 45, wherein the fluid storage apparatus is located above the surface of the earth.

47. The system according to any one of paragraphs 30 to 46, wherein an elevation of the water-rich product in the fluid storage apparats provides the water-rich product with a sufficient hydrostatic pressure to cause the water-rich product to flow into the inlet of the pressurizing apparatus.

48. The system according to any one of paragraphs 30 to 47, wherein the pressurizing apparatus is a vertical submersible pump.

49. The system according to any one of paragraphs 30 to 47, wherein the pressurizing apparatus is a vertical submersible pump comprising the outlet, a rotating component, the inlet, and a motor, wherein: the motor is located at a first end of the pressurizing apparatus, the outlet is located at a second end of the apparatus, the rotating component is located adjacent the outlet, and the inlet is located between the motor and the rotating component.

50. The system according to any one of paragraphs 30 to 47, wherein the pressurizing apparatus is a vertical submersible pump comprising the outlet, a rotating component, the inlet, a seal, and a motor, wherein: the motor is located at a first end of the pressurizing apparatus, the outlet is located at a second end of the apparatus, the rotating component is located adjacent the outlet, the seal is located adjacent the motor, and the inlet is located between the seal and the rotating component.

51. The system according to any one of paragraphs 30 to 47, wherein the pressurizing apparatus is a vertical submersible pump comprising the outlet, a rotating component, the inlet, a seal, a motor, and a shroud, wherein: the motor is located at a first end of the pressurizing apparatus, the outlet is located at a second end of the apparatus, the pump is located adjacent the outlet, the seal is located adjacent the motor, the inlet is located between the seal and the rotating component, and the shroud is disposed about the inlet, the seal, and at least a portion of the motor such that the fluid within the subterranean housing flows between an exterior surface of the at least a portion of the motor, an exterior surface of the seal, and into the inlet.

52. A process for injecting a fluid into an injection well, comprising: recovering a fluid from a fluid storage apparats located on a surface of the earth; introducing a fluid into a subterranean housing comprising a pressurizing apparatus at least partially disposed therein, wherein the subterranean housing is at least partially disposed under a surface of the earth, and wherein the pressurizing apparatus has an inlet located within the subterranean housing and below the surface of the earth; introducing the fluid from the subterranean housing into the inlet of the pressurizing apparatus; and introducing a pressurized fluid from an outlet of the pressurizing apparatus into an injection well.

53. The process according to paragraph 52, wherein the fluid introduced into the subterranean housing is recovered from a fluid storage apparatus disposed on the surface of the earth.

54. The process according to paragraph 52 or 53, wherein the inlet of the pressurizing apparatus is located below the outlet of the pressurizing apparatus.

55. The process according to any one of paragraphs 52 to 54, wherein the inlet of the pressurizing apparatus is located below the outlet of the pressurizing apparatus.

56. The process according to any one of paragraphs 52 to 54 wherein a longitudinal axis of the pressurizing apparatus is substantially vertical.

57. The process according to any one of paragraphs 52 to 56, wherein a hydrostatic pressure of the fluid is sufficient to introduce the fluid into the inlet of the pressurizing apparatus.

58. The process according to any one of paragraphs 52 to 56, wherein a hydrostatic pressure of the fluid within the subterranean housing causes the introduction of the fluid from the subterranean housing into the inlet of the pressurizing apparatus.

59. The process according to any one of paragraphs 52 to 56, wherein a charge pump increases a pressure of the fluid from the fluid storage apparatus prior to introducing the water-rich product from the fluid storage apparatus into the subterranean housing.

60. The process according to any one of paragraphs 52 to 59, wherein the subterranean housing comprises a first container at least partially disposed within a second container.

61. The process according to paragraph 60, wherein a substantially annular volume is defined between an outer sidewall surface of the first container and an inner sidewall surface of the second container.

62. The process according to paragraph 60 or 61, wherein a substantially cylindrical volume is formed between an outer bottom wall surface of the first container and an inner bottom wall surface of the second container.

63. The process according to paragraph 61 or 62, wherein a sensor configured to detect a presence of the fluid is disposed within the substantially annular volume or the substantially cylindrical volume.

64. The process according to paragraph 61 or 62, wherein a sensor configured to detect a presence of a formation fluid introduced thereto from a subterranean formation location adjacent the second container is disposed within the substantially annular volume or the substantially cylindrical volume.

65. The process according to paragraph 61 or 62, wherein a barrier fluid is disposed within the substantially annular volume, the substantially cylindrical volume, or the substantially annular volume and the substantially cylindrical volume.

66. The process according to paragraph 65, wherein a sensor configured to detect a change in a pressure of the barrier fluid is disposed within the substantially annular volume or the substantially cylindrical volume.

67. The process according to paragraph 65 or 66, wherein the barrier fluid comprises a gas, a liquid, or a mixture of a gas and a liquid.

68. The process according to any one of paragraphs 52 to 67, further comprising monitoring a flow rate of the fluid from the fluid storage apparatus into the subterranean housing; and adjusting the flow rate of the fluid to maintain a pre-determined flow rate of the fluid into the inlet of the pressurizing apparatus.

69. The process according to any one of paragraphs 52 to 68, further comprising monitoring an amount of fluid in the fluid storage apparatus and adjusting the amount of fluid in the fluid storage apparatus to maintain a pre-determined flow rate of the fluid into the inlet of the pressurizing apparatus.

70. The process according to any one of paragraphs 52 to 69, wherein the fluid storage apparatus is located above the surface of the earth.

71. The process according to any one of paragraphs 52 to 70, wherein an elevation of the fluid in the storage apparatus provides the fluid with a sufficient hydrostatic pressure to cause the fluid to flow into the inlet of the pressurizing apparatus.

72. The process according to any one of paragraphs 52 to 72, further comprising adjusting a flow rate of the fluid introduced from the subterranean housing into the inlet of the pressurizing apparatus.

73. The process according to any one of paragraphs 52 to 72, further comprising adjusting a flow rate of the fluid introduced from the subterranean housing into the inlet of the pressurizing apparatus by varying an operational speed of the pressurizing apparatus.

74. The process according to any one of paragraphs 52 to 73, further comprising adjusting a flow rate of the pressurized fluid from the outlet of the pressurizing apparatus into the injection well.

75. The process according to any one of paragraphs 52 to 74, further comprising adjusting a flow rate of the pressurized fluid product from the outlet of the pressurizing apparatus into the injection well by varying an operational speed of the pressurizing apparatus.

76. The process according to any one of paragraphs 52 to 75, further comprising monitoring a vibration of the pressurizing apparatus, and automatically shutting the pressurizing apparatus off if the vibration exceeds a pre-determined value.

77. The process according to any one of paragraphs 52 to 75, wherein a vibration of the pressurizing apparatus is not monitored.

78. The process according to any one of paragraphs 52 to 77, wherein the pressurizing apparatus is a vertical submersible pump.

79. The process according to any one of paragraphs 52 to 77, wherein the pressurizing apparatus is a vertical submersible pump comprising the outlet, a rotating component, the inlet, and a motor, wherein: the motor is located at a first end of the pressurizing apparatus, the outlet is located at a second end of the apparatus, the rotating component is located adjacent the outlet, and the inlet is located between the motor and the rotating component.

80. The process according to any one of paragraphs 52 to 77, wherein the pressurizing apparatus is a vertical submersible pump comprising the outlet, a rotating component, the inlet, a seal, and a motor, wherein: the motor is located at a first end of the pressurizing apparatus, the outlet is located at a second end of the apparatus, the rotating component is located adjacent the outlet, the seal is located adjacent the motor, and the inlet is located between the seal and the rotating component.

81. The process according to any one of paragraphs 52 to 77, wherein the pressurizing apparatus is a vertical submersible pump comprising the outlet, a rotating component, the inlet, a seal, a motor, and a shroud, wherein: the motor is located at a first end of the pressurizing apparatus, the outlet is located at a second end of the apparatus, the rotating component is located adjacent the outlet, the seal is located adjacent the motor, the inlet is located between the seal and the rotating component, and the shroud is disposed about the inlet, the seal, and at least a portion of the motor such that the fluid within the subterranean housing flows between an exterior surface of the at least a portion of the motor, an exterior surface of the seal, and into the inlet.

82. The process according to any one of paragraphs 52 to 81, wherein the pressurized fluid product is at a pressure of about 6.5 MPa, to about 35 MPa.

83. The process according to any one of paragraphs 52 to 82, wherein the fluid comprises a water-rich product.

84. The process according to paragraph 83, wherein the water-rich product is separated from a hydrocarbon production fluid comprising one or more hydrocarbons and water.

85. The process according to any one of paragraphs 52 to 82, wherein the fluid comprises a water-rich product, and wherein the water-rich product is separated from a crude oil or a fraction derived from crude oil.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for injecting into an injection well, comprising:

introducing a water-rich product separated from a hydrocarbon production fluid comprising one or more hydrocarbons and water into a fluid storage apparatus;

introducing the water-rich product from the fluid storage apparatus into a subterranean housing comprising a pressurizing apparatus at least partially disposed therein, wherein:

the subterranean housing is at least partially disposed under a surface of the earth, the pressurizing apparatus has an inlet located within the subterranean housing and below the surface of the earth, the subterranean housing comprises a first container at least partially disposed within a second container, an annular volume is defined between an outer sidewall surface of the first container and an inner sidewall surface of the second container, a cylindrical volume is defined between an outer bottom wall surface of the first container and an inner bottom wall surface of the second container, a barrier fluid is disposed within the cylindrical volume, the annular volume, or both, and a sensor configured to detect a change in pressure of the barrier fluid is disposed within the cylindrical volume or the annular volume;

introducing the water-rich product from the subterranean housing into the inlet of the pressurizing apparatus; and introducing a pressurized water-rich product from an outlet of the pressurizing apparatus into an injection well.

2. The process of claim 1, wherein the inlet of the pressurizing apparatus is located beneath the outlet of the pressurizing apparatus.

3. The process of claim 1, wherein a longitudinal axis of the pressurizing apparatus is substantially vertical.

4. The process of claim 1, wherein a hydrostatic pressure of the water-rich product within the subterranean housing is sufficient to introduce the water-rich product into the inlet of the pressurizing apparatus.

5. The process of claim 1, wherein a hydrostatic pressure of the water-rich product within the subterranean housing causes the introduction of the water-rich product from the subterranean housing into the inlet of the pressurizing apparatus.

6. The process of claim 1, wherein a charge pump increases a pressure of the water-rich product from the fluid storage apparatus prior to introducing the water-rich product from the fluid storage apparatus into the subterranean housing.

7. The process of claim 1, wherein an elevation of the water-rich product in the fluid storage apparatus provides the water-rich product with a sufficient hydrostatic pressure to cause the water-rich product to flow into the inlet of the pressurizing apparatus.

8. The process of claim 1, further comprising adjusting a flow rate of the pressurized water-rich product from the outlet of the pressurizing apparatus into the injection well by varying an operational speed of the pressurizing apparatus.

9. The process of claim 1, wherein a vibration of the pressurizing apparatus is not monitored.

10. The process of claim 1, wherein the pressurizing apparatus is a vertical submersible pump.

11. The process of claim 1, wherein the pressurizing apparatus is a vertical submersible pump comprising the outlet, the inlet, and a motor, wherein:

the motor is located at a first end of the pressurizing apparatus, the outlet is located at a second end of the apparatus, and the inlet is located between the motor and the pump.

12. The process of claim 1, wherein the pressurizing apparatus is a vertical submersible pump comprising the outlet, the inlet, a seal, and a motor, wherein:

the motor is located at a first end of the pressurizing apparatus, the outlet is located at a second end of the apparatus, the seal is located adjacent the motor, and the inlet is located between the seal and the pump.

13. The process of claim 1, wherein the pressurizing apparatus is a vertical submersible pump comprising the outlet, the inlet, a seal, a motor, and a shroud, wherein:

the motor is located at a first end of the pressurizing apparatus, the outlet is located at a second end of the apparatus, the seal is located adjacent the motor, the inlet is located between the seal and the pump, and the shroud is disposed about the inlet, the seal, and at least a portion of the motor such that the water-rich product within the subterranean housing flows between an exterior surface of the at least a portion of the motor, an exterior surface of the seal, and into the inlet.

14. A system for injecting into an injection well, comprising:

a fluid storage apparatus configured to store a water-rich product separated from a hydrocarbon production fluid;

a subterranean housing comprising a pressurizing apparatus at least partially disposed therein, wherein:

the subterranean housing is at least partially disposed under a surface of the earth, the pressurizing apparatus comprises an inlet located within the subterranean housing and below the surface of the earth, the pressurizing apparatus comprises an outlet configured to eject a pressurized water-rich product therefrom, the subterranean housing comprises a first container at least partially disposed within a second container, an annular volume is defined between an outer sidewall surface of the first container and an inner sidewall surface of the second container, a cylindrical volume is defined between an outer bottom wall surface of the first container and an inner bottom wall surface of the second container, a barrier fluid is disposed within the cylindrical volume, the annular volume, or both, and a sensor configured to detect a change in pressure of the barrier fluid is disposed within the cylindrical volume or the annular volume; and an injection well configured to introduce the pressurized water-rich product into a subterranean formation.

15. The system of claim 14, wherein the subterranean formation is a disposal well, and wherein the fluid storage apparatus is located on a surface of the earth.

16. The system of claim 14, wherein the pressurizing apparatus is a vertical submersible pump.

17. The system of claim 14, wherein the pressurizing apparatus is a vertical submersible pump comprising the outlet, the inlet, a seal, a motor, and a shroud, and wherein:

the motor is located at a first end of the pressurizing apparatus, the outlet is located at a second end of the apparatus, the seal is located adjacent the motor, the inlet is located between the seal and the pump, and the shroud is disposed about the inlet, the seal, and at least a portion of the motor such that the water-rich product within the subterranean housing flows between an exterior surface of the at least a portion of the motor, an exterior surface of the seal, and into the inlet.

18. A process for injecting into an injection well, comprising:

recovering a fluid from a fluid storage apparatus located on a surface of the earth;

introducing the fluid into a subterranean housing comprising a pressurizing apparatus at least partially disposed therein, wherein:

the subterranean housing is at least partially disposed under a surface of the earth, the pressurizing apparatus has an inlet located within the subterranean housing and below the surface of the earth, the subterranean housing comprises a first container at least partially disposed within a second container, an annular volume is defined between an outer sidewall surface of the first container and an inner sidewall surface of the second container, a cylindrical volume is defined between an outer bottom wall surface of the first container and an inner bottom wall surface of the second container, a barrier fluid is disposed within the cylindrical volume, the annular volume, or both, and a sensor configured to detect a change in pressure of the barrier fluid is disposed within the cylindrical volume or the annular volume;

introducing the fluid from the subterranean housing into the inlet of the pressurizing apparatus; and introducing a pressurized fluid from an outlet of the pressurizing apparatus into an injection well.

19. The process of claim 18, wherein the pressurizing apparatus is a vertical submersible pump.

20. The process of claim 18, wherein the pressurizing apparatus is a vertical submersible pump comprising the outlet, the inlet, a seal, a motor, and a shroud, and wherein:

the motor is located at a first end of the pressurizing apparatus, the outlet is located at a second end of the apparatus, the seal is located adjacent the motor, the inlet is located between the seal and the pump, and the shroud is disposed about the inlet, the seal, and at least a portion of the motor such that the water-rich product within the subterranean housing flows between an exterior surface of the at least a portion of the motor, an exterior surface of the seal, and into the inlet.

* * * * *